US007218200B2

(12) United States Patent
Hayashi et al.

(10) Patent No.: US 7,218,200 B2
(45) Date of Patent: May 15, 2007

(54) MANUAL-RESET THERMOSTAT

(75) Inventors: Toshiharu Hayashi, Osaka (JP); Masato Minamiura, Osaka (JP)

(73) Assignee: Wako Electronics Co., Ltd., Osaka (JP)

( * ) Notice: Subject to any disclaimer, the term of this patent is extended or adjusted under 35 U.S.C. 154(b) by 298 days.

(21) Appl. No.: 10/967,522

(22) Filed: Oct. 18, 2004

(65) Prior Publication Data

US 2006/0082432 A1 Apr. 20, 2006

(30) Foreign Application Priority Data

Jun. 10, 2004 (JP) ..... 2004-172238

(51) Int. Cl.
*H01H 37/54* (2006.01)
*H01H 37/70* (2006.01)

(52) U.S. Cl. ..... 337/348; 337/333; 337/343

(58) Field of Classification Search ..... 337/333, 337/343, 348
See application file for complete search history.

(56) References Cited

U.S. PATENT DOCUMENTS 3,219,783 A 11/1965 Odson
3,525,968 A * 8/1970 Hire ..... 337/348
3,609,622 A * 9/1971 Pringle et al. ..... 337/354
3,621,434 A * 11/1971 Gerich ..... 337/248
3,686,605 A * 8/1972 Hire ..... 337/334
3,715,699 A * 2/1973 Hire ..... 337/348
3,718,880 A * 2/1973 Pringle et al. ..... 337/380
3,720,899 A * 3/1973 Hire et al. ..... 337/348
3,781,744 A * 12/1973 Olson ..... 337/118
3,832,667 A * 8/1974 Blanton ..... 337/354
3,852,697 A * 12/1974 Snider ..... 337/348
3,924,213 A * 12/1975 Semple ..... 337/130
4,039,991 A * 8/1977 Bucheister ..... 337/348
4,053,859 A * 10/1977 Hollweck ..... 337/91
4,470,033 A * 9/1984 Hofsass ..... 337/343
4,513,570 A * 4/1985 Yoshida et al. ..... 60/529
4,841,271 A * 6/1989 Purssell ..... 337/320
5,003,282 A 3/1991 Boulanger
5,157,370 A * 10/1992 Engelbach et al. ..... 337/348
5,270,799 A * 12/1993 Rose ..... 337/354
5,596,307 A * 1/1997 Hayashi et al. ..... 337/298
5,703,560 A * 12/1997 Short et al. ..... 337/348
5,929,742 A 7/1999 Short

FOREIGN PATENT DOCUMENTS

JP 9-198980 7/1997

* cited by examiner

*Primary Examiner*—Anatoly Vortman
(74) *Attorney, Agent, or Firm*—Vedder Price Kaufman & Kammholz

(57) ABSTRACT

A movable operating member 5 is swingably borne by the base 1, and its distal end is moved upward by allowing its proximal end 5*b* to be pressed downward. The movable contact 3 is separated from the stationary contact 2 upward by moving the distal end of the movable operating member 5 upward. The proximal end of the movable operating member 5 is pressed downward by a guide pin 6 in response to a reverse action of a bimetal 7. When a reset shaft 8 is pushed upward, the movable contact 3 is pressed upward, and the guide pin 6 is pressed upward so that the bimetal 7 can be returned to an initial state.

8 Claims, 9 Drawing Sheets

MANUAL-RESET THERMOSTAT

BACKGROUND OF THE INVENTION

1. Field of the Invention

The present invention relates to a thermostat that performs providing or interrupting electrical continuity in response to temperature changes. More specifically, the present invention relates to a manual-reset thermostat that, once a bimetal performs a reverse action, maintains a reversely-curved state until a reset shaft is pushed.

2. Description of the Related Art

A thermostat is an electronic part that performs providing or interrupting electrical continuity by opening or closing contact between connecting terminals making use of the fact that a disk-shaped bimetal performs a snap action in response to temperature changes. In more detail, electrical continuity is interrupted by opening (i.e., breaking) contact between connecting terminals in response to a reverse action of a bimetal when a predetermined temperature is reached by a temperature rise, whereas electrical continuity is re provided between the connecting terminals by closing (i.e., making) contact between the connecting terminals in response to a return action of the bimetal when another predetermined temperature is reached by a temperature drop.

Herein, if a temperature at which the bimetal is reset is set below a normal temperature, and once the bimetal performs a reverse action, the bimetal maintains a reversely-curved state even if the normal temperature is reached by a temperature drop unless the bimetal is manually allowed to perform a return action. This type of thermostat is called a "manual-reset thermostat." This manual-reset thermostat is used in various apparatuses such as copying machines. If an abnormality arises in an apparatus in which the manual-reset thermostat is used causes the apparatus to reach a high temperature, the electric current is shut off by allowing the bimetal to perform a reverse action, and the apparatus is stopped. Since this state is maintained even when the normal temperature is reached, causes of the abnormality occurred in the apparatus is removed, and thereafter the bimetal is manually reset by pushing a reset shaft.

FIG. 10A, FIG. 10B, and FIG. 10C are sectional views, each showing a conventional manual-reset thermostat, in which FIG. 10A shows an initial state, FIG. 10B shows a state in which a bimetal "A" has performed a reverse action, and FIG. 10C shows a state in which the bimetal "A" has returned to the initial state by pushing a reset shaft B. This thermostat includes the bimetal "A" that performs a snap operation, a guide pin C disposed under the bimetal "A," a leaf spring D to which the reverse action of the bimetal "A" is transmitted through the guide pin C, the reset shaft B disposed under the guide pin C with the leaf spring D therebetween, a movable contact E provided at an end of the leaf spring D, and a stationary contact F that is fixed facing the upper part of the movable contact E.

This conventional thermostat is used in the state of FIG. 10A. The bimetal "A" is kept convex upward, and, when the movable contact E and the stationary contact F come into contact with each other, an electric current is applied to an apparatus having this thermostat. However, when a predetermined temperature is reached owing to an abnormality of the apparatus, the bimetal "A" performs a reverse action and reaches a state of being convex downward as shown in FIG. 10B, so that the guide pin C is pushed downward. Accordingly, the leaf spring D is depressed through the guide pin C, and the movable contact E recedes from the stationary contact F downward. As a result, the movable contact E and the stationary contact F are separated from each other, and the electric current to the apparatus is shut off.

In this thermostat, once the bimetal "A" performs a reverse action, the reversely-curved state of the bimetal "A" is maintained even if the temperature falls to a normal temperature. Therefore, in order to return the thermostat to the initial state of FIG. 10A, the reset shaft B is required to be pushed as shown in FIG. 10C. When the reset shaft B is pushed, the bimetal "A" is pushed upward through the leaf spring D and the guide pin C, and the bimetal "A" is returned to the state of being convex upward. When the reset shaft B is brought into a free state after having pushed the reset shaft B, the thermostat returns to the state of FIG. 10A, but the movable contact E and the stationary contact F continue to be in contact with each other by an upward urging force of the leaf spring D.

However, in this conventional thermostat, if the reset shaft B of the thermostat continues to be pushed owing to some circumstances when the apparatus is being used, the state of FIG. 10C is maintained. If so, the bimetal "A" cannot perform a reverse action even when a predetermined temperature is reached later, so that the contacts cannot be separated from each other. Therefore, there has been a fear that the electric current will continue to be applied damaging the apparatus.

From this fact, the present patent applicant has proposed a thermostat disclosed in Japanese Unexamined Patent Application Publication No. H9-198980. FIG. 11A, FIG. 11B, and FIG. 11C are sectional views, each showing this conventional manual-reset thermostat, in which FIG. 11A shows an initial state, FIG. 11B shows a state in which the bimetal "A" has performed a reverse action, and FIG. 11C shows a state in which the bimetal "A" has been returned to the initial state by pushing the reset shaft B.

As shown in FIGS. 11A to 11C, this conventional thermostat includes two make-and-break contacts consisting of movable contacts E1 and E2 and stationary contacts F1 and F2. The movable contacts E1 and E2 are provided at both ends, respectively, of a plate D1. When the bimetal "A" performs a reverse action, one of the two make-and-break contacts is opened, i.e., the contacts E1 and F1 are opened. On the other hand, when the reset shaft B is pushed, the other make-and-break contact is opened, i.e., the contacts E2 and F2 are opened. Therefore, an electric current to an apparatus having this thermostat can be shut off in a state in which the reset shaft B is being pushed.

However, the conventional thermostat of FIGS. 11A to 11C needs the two make-and-break contacts, and, accordingly, the number of constituent elements becomes large, and the structure thereof becomes complex, and costs become high. It is therefore an object of the present invention to provide a manual-reset thermostat that can interrupt electrical continuity in a state in which a reset shaft is being pushed and that has a simple structure.

SUMMARY OF THE INVENTION

According to the present invention, a manual-reset thermostat in which an internal connection between connecting terminals is interrupted by a reverse action of a bimetal and in which the internal connection between the connecting terminals is reset by inserting a reset shaft is characterized by comprising: a make-and-break contact consisting of a movable contact and a stationary contact, the movable contact being moved in response to a reverse action of the bimetal or in response to an inserting action of the reset shaft, the stationary contact facing the movable contact and being fixedly disposed; wherein the movable contact is disposed closer to the bimetal than the stationary contact and is urged opposite the bimetal so that the make-and-break contact is closed, the movable contact being moved toward the bimetal against an urging force in response to the reverse action of the bimetal so that the make-and-break contact is opened, the movable contact being moved toward the bimetal when the reset shaft is inserted, so that the make-and-break contact is opened, this state being maintained as long as the reset shaft is inserted.

Further, according to the present invention, a manual-reset thermostat is characterized by comprising: a movable contact disposed above a stationary contact and urged downward so as to come into contact with the stationary contact; a movable operating member whose distal end is moved upward by allowing a proximal end thereof to be pressed downward, the movable operating member separating the movable contact from the stationary contact upward by moving the distal end upward; a guide pin that presses the proximal end of the movable operating member downward in response to the reverse action of the bimetal; and a reset shaft that returns the bimetal to an initial state via the guide pin, the reset shaft pressing the movable operating member upward, the movable operating member pressing the guide pin upward and also pressing the movable contact upward.

Further, according to the present invention, a manual-reset thermostat is characterized by comprising: a stationary contact fixed to a base; a movable contact urged downward by a leaf spring so as to come into contact with an upper surface of the stationary contact; a movable operating member that is swingably borne by the base and in which a distal end thereof is moved upward by allowing a proximal end thereof to be pressed downward and in which the movable contact is separated from the stationary contact upward by moving the distal end thereof upward; a guide pin disposed on an upper part on the side of the proximal end of the movable operating member so as to be vertically movable, the guide pin pressing the proximal end of the movable operating member downward in response to a reverse action of a bimetal; and a reset shaft disposed on a lower part of the movable operating member so as to be vertically movable, the reset shaft pressing the movable operating member upward, the distal end of the movable operating member pressing the movable contact upward, the proximal end of the movable operating member pressing the guide pin upward making the bimetal return to an initial state.

Further, according to the present invention, a manual-reset thermostat is characterized by comprising: a stationary contact fixed to a base; a movable contact urged downward by a leaf spring so as to come into contact with an upper surface of the stationary contact; a guide pin disposed on an upper part of the leaf spring so as to be vertically movable, the guide pin pressing a middle part of the leaf spring downward in response to a reverse action of a bimetal and curving the distal end of the leaf spring upward, making the movable contact provided at the distal end of the leaf spring separate from the stationary contact upward; and a reset shaft disposed on a lower part of the leaf spring so as to be vertically movable, said reset shaft pressing a middle part of the leaf spring upward, making the movable contact separate from the stationary contact upward and making the bimetal return to an initial state by pushing the guide pin upward.

According to the present invention, the manual-reset thermostat that reliably interrupts electrical continuity in a state in which a reset shaft is being pushed can be provided to have a simple structure at low cost.

BRIEF DESCRIPTION OF THE DRAWINGS

FIG. 8A and FIG. 8B are longitudinal sectional views, each showing a second embodiment of the manual-reset thermostat according to the present invention, in which FIG. 8A shows an initial state of the thermostat, and FIG. 8B shows a state in which the bimetal has performed a reverse action.

FIG. 9A, FIG. 9B, FIG. 9C, and FIG. 9D are longitudinal sectional views, each showing a third embodiment of the manual-reset thermostat according to the present invention, in which FIG. 9A shows an initial state of the thermostat, FIG. 9B shows a state in which the bimetal has performed a reverse action, FIG. 9C shows a state in which the bimetal is being returned to the initial state by pushing the reset shaft, and FIG. 9D shows a state in which the bimetal has been returned to the initial state by pushing the reset shaft.

FIG. 10A, FIG. 10B, and FIG. 10C are sectional views, each showing a conventional manual-reset thermostat, in which FIG. 10A shows an initial state, FIG. 10B shows a state in which the bimetal has performed a reverse action, and FIG. 10C shows a state in which the bimetal is returned to the initial state by pushing the reset shaft.

FIG. 11A, FIG. 11B, and FIG. 11C are sectional views, each showing the conventional manual-reset thermostat, in which FIG. 11A shows an initial state, FIG. 11B shows a state in which the bimetal has performed a reverse action, and FIG. 11C shows a state in which the bimetal is returned to the initial state by pushing the reset shaft.

DETAILED DESCRIPTION OF THE PREFERRED EMBODIMENTS

Embodiments of a manual-reset thermostat according to the present invention will be hereinafter described in detail with reference to the attached drawings.

Embodiment 1

Figure 1:
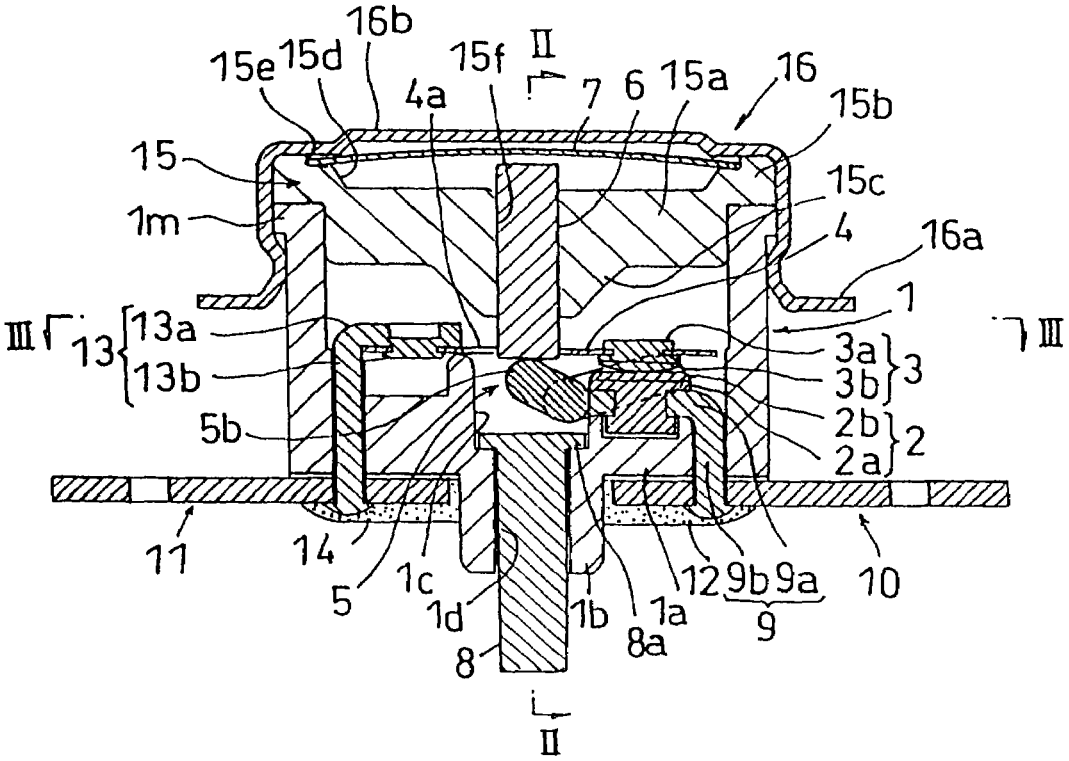
FIG. 1 is a longitudinal sectional view showing a first embodiment of a manual-reset thermostat according to the present invention.
Figure 2:
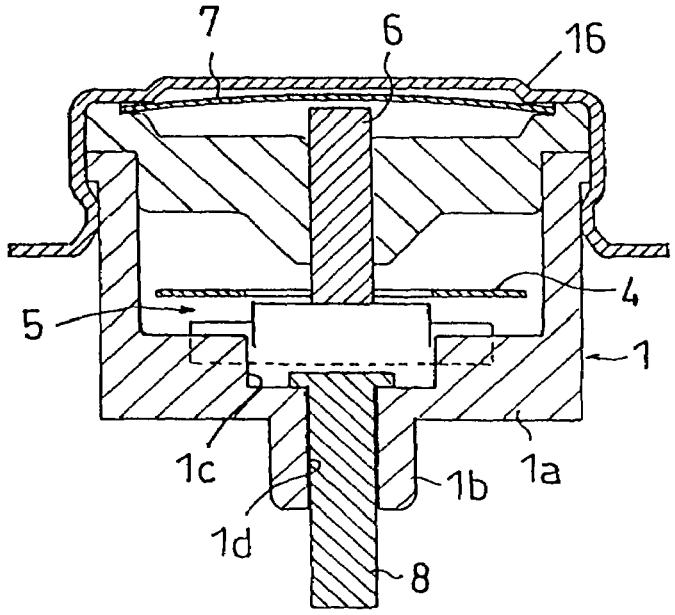
FIG. 2 is a sectional view along line II—II of FIG. 1.
Figure 3:
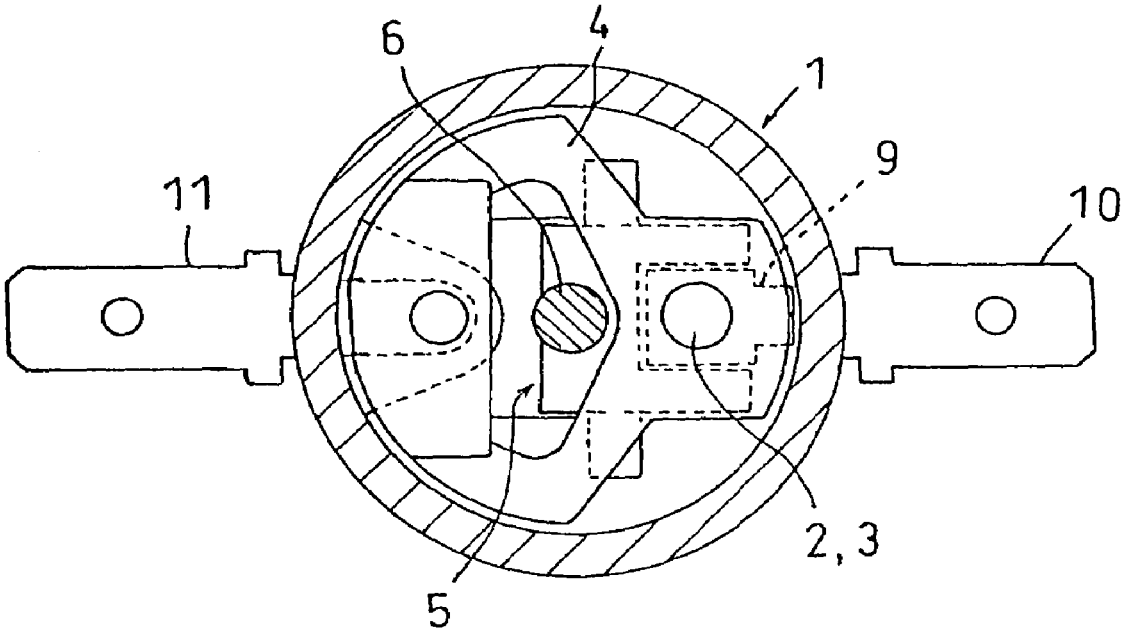
FIG. 3 is a sectional view along line III—III of FIG. 1.
Figure 4:
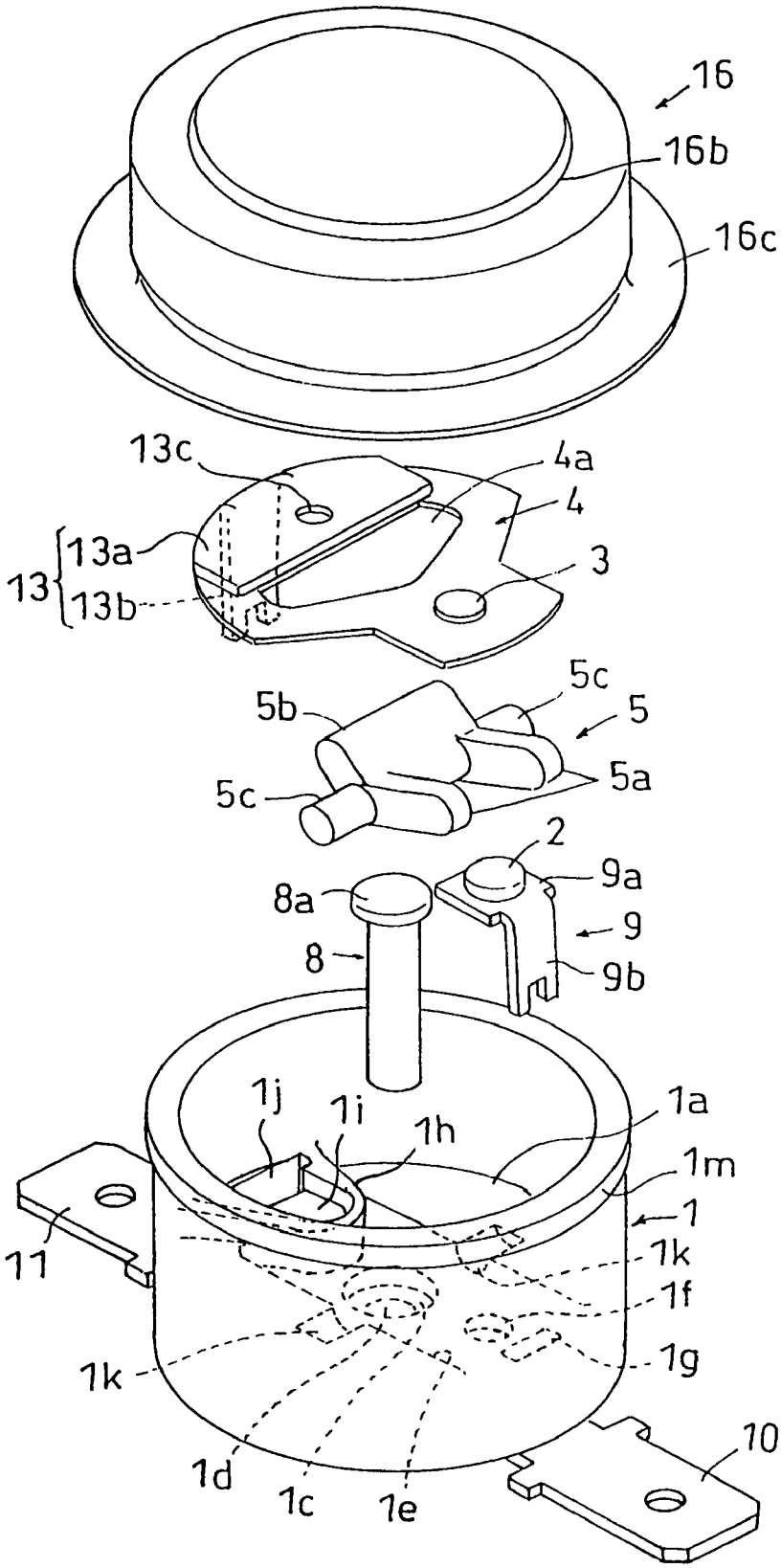
FIG. 4 is an exploded perspective view of the thermostat of FIG. 1, in which the inner lid, the guide pin, and the bimetal are omitted.

FIG. 1 is a longitudinal sectional view showing a first embodiment of a manual-reset thermostat according to the present invention. FIG. 2 is a sectional view along line II—II of FIG. 1, and FIG. 3 is a sectional view along line III—III of FIG. 1. FIG. 4 is an exploded perspective view of the thermostat in this embodiment. An inner lid 15, a guide pin 6, and a bimetal 7, which are described later, are not shown in FIG. 4.

The thermostat in this embodiment mainly has made up of a stationary contact 2 fixed to a base 1, a movable contact 3 that is brought into contact with the stationary contact 2 or is separated therefrom, a leaf spring 4 by which the movable contact 3 is urged to the stationary contact 2, a movable operating member 5 that separates the movable contact 3 from the stationary contact 2 against an urging force of the leaf spring 4, the bimetal 7 that allows the movable operating member 5 to operate through the guide pin 6 by performing a reverse action at a predetermined temperature, and a reset shaft 8 that resets the bimetal 7 from a reversely-curved state.

The base 1 in this embodiment is formed of a closed-end cylindrical housing that is opened upward. A boss 1*b* cylindrically protrude downward is integrally formed at the center of a bottom wall 1*a* of the housing 1. Shaft-insertion holes 1*c* and 1*d* are formed at the middle of the boss 1*b* so as to vertically pass through the bottom wall 1*a*. The upper one of the insertion holes is formed as a large-diameter hole 1*c*, and the lower hole is formed as a small-diameter hole 1*d*. The reset shaft 8 is held in the shaft-insertion holes 1*c* and 1*d* so as to be movable upwardly and downwardly.

The reset shaft 8 in this embodiment is shaped like a round rod. A collar portion 8*a* is formed on the upper end of the reset shaft 8 so as to protrude radially outward. Preferably, the upper surface of the collar portion 8*a* is tabularly formed as shown in FIG. 4 although the upper surface thereof can be shaped like a gentle sphere so as to expand upward. The reset shaft 8 is inserted into the shaft-insertion holes 1*c* and 1*d* while the collar portion 8*a* is disposed at the large-diameter hole 1*c*. The reset shaft 8 inserted in the shaft-insertion holes 1*c* and 1*d* is movable upward and downward.

As shown in FIG. 4, a substantially rectangular concave portion 1*e* is formed downward on the upper surface of the bottom wall of the housing 1. A circularly-formed first depression if and a substantially rectangularly-formed first insertion hole 1*g* are formed at the right side of the bottom surface of the concave portion 1*e*. The first insertion hole 1*g* is formed to be slender forward and backward, and vertically passes through the bottom wall 1*a* of the housing 1.

On the other hand, a shoulder portion 1*h* erected upward is formed at the left of the substantially rectangular concave portion 1*e*. A substantially rectangular second depression 1*i* is formed on the upper surface of the shoulder portion 1*h*. The right part of the second depression 1*i* is shaped like a semicircle. A substantially rectangular second insertion hole 1*j* is formed adjacent to the left side of the second depression 1*i*. The second insertion hole 1*j* is formed to be slender forward and backward, and vertically passes through the bottom wall 1*a* of the housing 1.

A first connecting member 9 is provided at the first insertion hole 1*g*. The first connecting member 9 is made of a metallic plate bent almost like the capital letter L, and is made up of a horizontal piece 9*a* placed horizontally and a vertical piece 9*b* extending vertically downward from the right end of the horizontal piece 9*a*. The horizontal piece 9*a* has the stationary contact 2. The stationary contact 2 is formed by integrally superposing a silver-alloy-made top part 2*b* shaped like a disk upon the upper surface of a copper-made main part 2*a* shaped like a stepped short cylinder. After a small-diameter part under the main part 2*a* is passed through a hole of the horizontal piece 9*a*, the thus formed stationary contact 2 is fixed to the horizontal piece 9*a* by fastening its lower part.

A first terminal 10 and a second terminal 11 are provided on the bottom wall 1*a* of the housing 1 at two locations, respectively, of the right and left parts of the housing 1 along the direction of the diameter of the housing 1 with the boss 1*b* therebetween. The first and second terminals 10 and 11 are each made of a substantially rectangular metallic plate, and are superposed on the bottom surface of the housing 1. When superposed, the first terminal 10 is provided at the side corresponding to the first depression 1*f* and the first insertion hole 1*g*, whereas the second terminal 11 is provided at the side corresponding to the second depression 1*i* and the second insertion hole 1*j*.

In the first connecting member 9 to which the stationary contact 2 is fixed, the vertical piece 9*b* is inserted into the first insertion hole 1*g*. The lower end of the first connecting member 9 is united with the first terminal 10 by being passed through the hole of the first terminal 10 and being fastened. A connected part therebetween is soldered with a solder 12.

On the other hand, a second connecting member 13 is provided at the second insertion hole 1*j* of the housing 1. The second connecting member 13 is made of a metallic plate bent almost like the capital letter L, and is made up of a horizontal piece 13*a* placed horizontally and a vertical piece 13*b* extending vertically downward from the left end of the horizontal piece 13*a*. As shown in FIG. 4, the width in the forward and backward directions of the horizontal piece 13*a* is greater than that of the vertical piece 13*b*. A proximal end of the leaf spring 4 is provided at the lower end surface of the horizontal piece 13*a*. The leaf spring 4 and the horizontal piece 13*a* are united together by inserting a circular projection 13*c* of the horizontal piece 13*a* extending downward into a round hole of the leaf spring 4 and by fastening its lower end.

The proximal end of the leaf spring 4 is shaped almost like a semicircle, and the distal end thereof is shaped almost like a rectangle. The circular arc of the proximal end is a size smaller than that of the housing 1. The leaf spring 4 has a through hole 4*a* at its middle, and has the movable contact 3 fixed to its distal end. The movable contact 3 is formed by integrally superposing a silver-alloy-made top part 3*b* shaped like a disk upon the undersurface of a copper-made main part 3*a* shaped like a stepped cylinder. After a small-diameter part above the main part 3*a* is passed through the hole of the leaf spring 4, the thus formed movable contact 3 is fixed to the leaf spring 4 by fastening its upper part.

In the second connecting member 13 to which the movable contact 3 is fixed through the leaf spring 4, the vertical piece 13*b* is inserted into the second insertion hole 1*j*. The lower end of the second connecting member 13 is united with the second terminal 11 by being passed through the hole of the second terminal 11 and being fastened. A connected part therebetween is soldered with a solder 14. In this state, the proximal end of the leaf spring 4 is held at the upper part of the shoulder portion 1*h* of the housing 1, and the through hole 4*a* is disposed at the center of the housing 1. The top part 3*b* of the movable contact 3 fixed to the distal end of the leaf spring 4 is disposed to face the top part 2*b* of the stationary contact 2. The movable contact 3 is always urged downward by the leaf spring 4 so as to be in contact with the stationary contact 2.

The bottom wall 1*a* of the housing 1 has bearing grooves 1*k* and 1*k* at a right angle with respect to a line connecting the first connecting member 9 and the second connecting member 13 together and at forward and backward positions with the shaft-insertion holes 1*c* and 1*d* therebetween. The bearing grooves 1*k* and 1*k* are formed on the wall surface forward and backward of the substantially rectangular concave portion 1*e*. The longitudinal section of each groove is shaped like a semicircle or like the letter U. The bearing grooves 1*k* and 1*k* extend in the forward and backward directions and are opened upward. The movable operating member 5 is swingably held in the bearing grooves 1*k*.

The movable operating member 5 in this embodiment is shaped like an overturned "U" that is opened rightward when viewed planarly, and is shaped almost like a gentle "V" when viewed frontally. In more detail, two legs 5*a* and 5*a* are provided at the middle in the longitudinal direction of round-rod-like shaft members (5*c*—5*c*) so as to extend radially outward. The shaft members are disposed in the forward and backward directions, and the leg 5*a* extends from the shaft members diagonally upward right. A planar connection portion 5*b* is provided between the legs 5*a* and 5*a*. The width of the connection portion 5*b* corresponds to the width between the two legs 5*a* and 5*a*. The connection portion 5*b* extends diagonally upward left with respect to the shaft member. Thus, the connection portion 5*b* and the leg 5*a* are disposed to be shaped almost like a "V" when viewed frontally. A gap between the legs 5*a* and 5*a* forward and backward is formed to be opened rightward. The shaft member further has shaft portions 5*c* and 5*c* that protrude from the connection portion 5*b* and the leg 5*a* outward in the forward and backward directions.

The movable operating member 5 is disposed such that the front and rear shaft portions 5*c* and 5*c* are held in the bearing grooves 1*k* and 1*k* of the housing 1. As a result, the movable operating member 5 can be swung around the shaft portions 5*c* and 5*c*. The distal ends of the legs 5*a* of the movable operating member 5 come into contact with the undersurface on the distal end side of the leaf spring 4. Therefore, when the movable operating member 5 is inclined around the shaft portion 5*c* so as to move its distal ends (i.e., right end of the leg 5*a*) upward, the moved distal ends of the legs separate the movable contact 3 from the stationary contact 2 upward.

The upper opening of the housing 1 is closed with the inner lid 15 and is then covered with a cap 16. The inner lid 15 is shaped like a stepped cylinder. The outer diameter of a small-diameter part 15*a* of the lower part of the inner lid 15 is designed to accommodate to the inner diameter of the housing 1. The outer diameter of a large-diameter part 15*b* of the upper part of the inner lid 15 is designed to accommodate to the outer diameter of a flange 1*m* of the upper part of the housing 1. Therefore, the small-diameter part 15*a* of the inner lid 15 is fitted to the upper opening of the housing 1, and the undersurface of the large-diameter part 15*b* is held while being in contact with the upper surface of the housing 1.

A projection 15*c* protruding downward and having the shape of a truncated cone is formed at the middle of the undersurface of the inner lid 15. Stepped shallow circular holes 15*d* and 15*e* concaved downward are formed in the upper surface of the inner lid 15. Furthermore, a pin-inserting hole 15*f* vertically passing through the inner lid 15 is formed at the middle of the inner lid 15. The round-rod-like guide pin 6 is inserted into the pin-inserting hole 15*f* so as to be movable upward and downward. The lower end of the guide pin 6 is passed through the through hole 4*a* of the leaf spring 4, and is held while being in contact with the upper surface of the center in the forward and backward directions of the proximal end (connection portion) 5*b* of the movable operating member 5. In this state, the upper end of the guide pin 6 is disposed inside the circular hole 15*d*.

The disk-shaped bimetal 7 is held by the large-diameter part 15*e* of the circular hole. The bimetal 7 being in an initial state is arcuately curved gently upward, and performs a reverse action so as to be convex downward when a predetermined temperature is reached. The bimetal 7 is disposed so that its outer peripheral part is held by the undersurface of the large-diameter hole 15*e*. The cap 16 is attached to the upper part of the inner lid 15 with the bimetal 7 therebetween.

The cap 16 has the shape of a cylinder that is opened only downward, and has a flange 16*a* extending radially outward at its lower end. The cap 16 is attached to the upper part of the housing 1 with the inner lid 15 and the bimetal 7 therebetween, and is fixed to the housing 1 by being fastened so that the outer peripheral part is reduced in size under the flange 1*m* of the housing 1. Hereby, the inner lid 15 is firmly placed between the upper end of the housing 1 and the peripheral part of the upper wall of the cap 16. A circular concave portion 16*b* concaved upward is formed on the upper wall of the cap 16 at the position corresponding to the small-diameter part 15*d* of the circular hole.

As mentioned above, the stationary contact 2, the movable contact 3, the leaf spring 4, the first connecting member 9, the second connecting member 13, the first terminal 10, and the second terminal 11 are each made of a conductive material such as a metal. On the other hand, the housing 1, the movable operating member 5, the guide pin 6, the reset shaft 8, and the inner lid 15 are each made of an insulating material such as resin.

The thermostat mentioned above is assembled in practice as follows. First, the second connecting member 13 is pre-attached to the proximal end of the leaf spring 4, and the movable contact 3 is pre-attached to the distal end thereof. Further, the stationary contact 2 is pre-attached to the upper end of the first connecting member 9. Furthermore, the reset shaft 8 is pre-inserted in the shaft-insertion holes 1*c* and 1*d* of the housing 1.

Thereafter, the first connecting member 9 is inserted into the first insertion hole 1*g* of the housing 1, and the lower end thereof is passed through the first terminal 10 disposed on the undersurface of the housing 1 and is fastened. Both are then soldered. Thereafter, the shaft portions 5*c* and 5*c* of the movable operating member 5 are disposed in the bearing grooves 1*k* and 1*k* of the housing 1, and the movable operating member 5 is held in the housing 1. Thereafter, the second connecting member 13 is inserted into the second insertion hole 1*j* of the housing 1, and the lower end thereof is passed through the second terminal 11 disposed on the undersurface of the housing 1 and is fastened. Both are then soldered.

Thereafter, the inner lid 15 is fitted to the upper part of the housing 1, and the guide pin 6 is inserted into the pin-inserting hole 15*f* thereof. Finally, the cap 16 is attached to the upper part of the housing 1 in a state in which the bimetal 7 is placed on the upper part of the inner lid 15, and the outer peripheral part of the cap 16 is firmly fastened.

As mentioned above, FIG. 1 is a sectional view showing the initial state of the thermostat in this embodiment. On the other hand, FIG. 5 to FIG. 7 are sectional views, each showing the thermostat, in which FIG. 5 shows a state in which the bimetal 7 has performed a reverse action, FIG. 6 shows a state in which the bimetal 7 is being returned to the initial state by pushing the reset shaft 8, and FIG. 7 shows a state in which the bimetal 7 has been returned to the initial state by pushing the reset shaft 8.

The thermostat is used in the state shown in FIG. 1. In this state, the bimetal 7 is convex upward, and the stationary contact 2 and the movable contact 3 are in contact with each other, thereby electrically connecting the first terminal 10 and the second terminal 11 together.

When the temperature becomes higher than a predetermined temperature owing to an abnormality occurring in an apparatus, the thermostat operates. At this time, the bimetal 7 performs a reverse action so as to be convex downward as shown in FIG. 5, and the guide pin 6 is pushed downward thereby. When the guide pin 6 is pushed downward, the proximal end 5*b* of the substantially V-shaped movable operating member 5 is pushed downward, and the movable operating member 5 slightly rotates counterclockwise around the shaft 5*c*. As a result, the distal end of the movable operating member 5 (i.e., the distal end of the leg 5*a*) moves the leaf spring 4 and the movable contact 3 fixed thereto upward, and the movable contact 3 is separated from the stationary contact 2. Thus, electrical continuity between the first terminal 10 and the second terminal 11 is interrupted.

Figure 5:
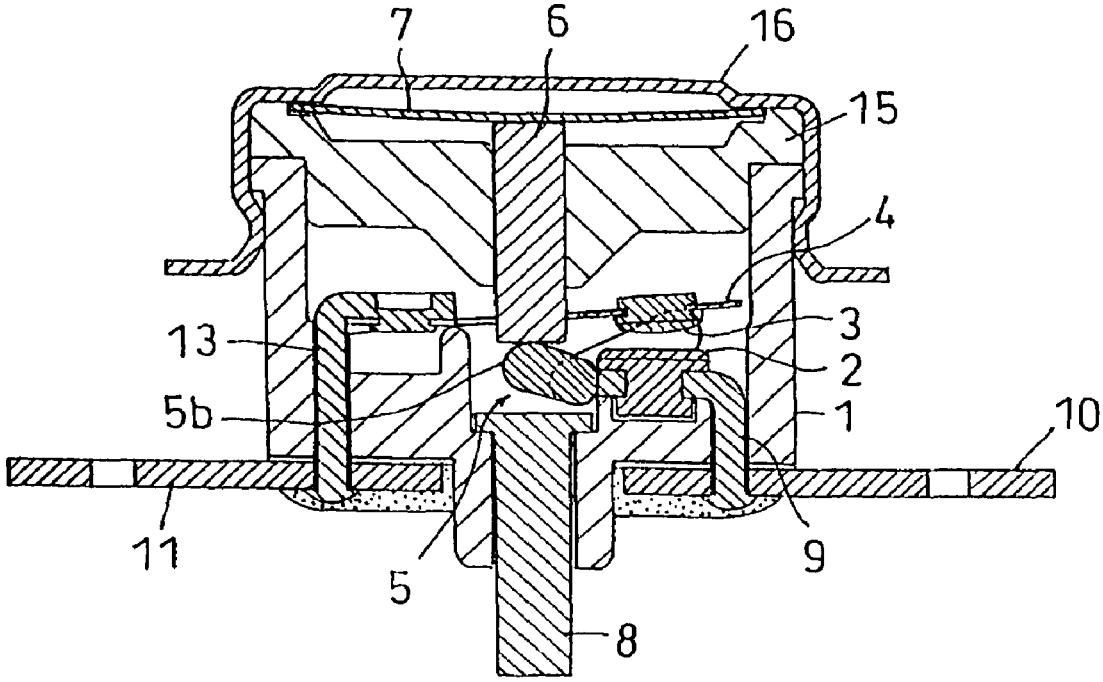
FIG. 5 shows a state in which the bimetal of the thermostat of FIG. 1 has performed a reverse action.
Figure 6:
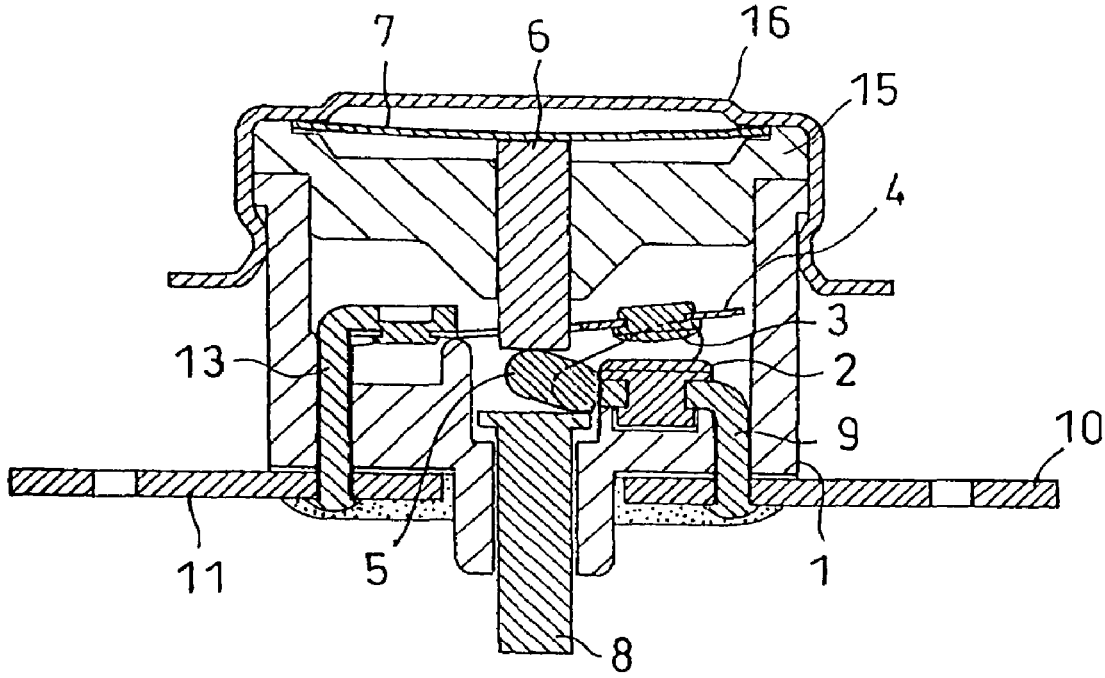
FIG. 6 shows a state in which the bimetal is being returned to the initial state by pushing the reset shaft of the thermostat of FIG. 5.
Figure 7:
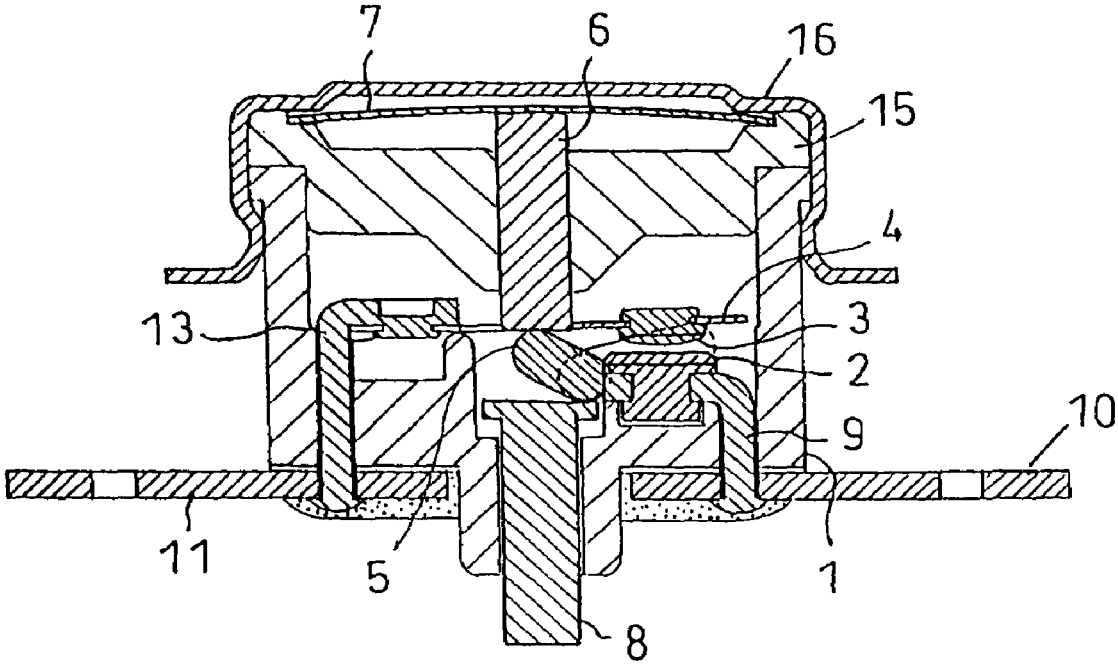
FIG. 7 shows a state in which the bimetal has been returned to the initial state by pushing the reset shaft of the thermostat of FIG. 6.

In order to return the thermostat from the state of FIG. 5 to the initial state of FIG. 1, it is recommended to push the reset shaft 8 upward as shown in FIG. 6 and FIG. 7. The movable operating member 5 is moved upward along the bearing groove 1*k* of the housing 1 by pushing the reset shaft 8 upward. The proximal end of the movable operating member 5 pushes the bimetal 7 upward via the guide pin 6 in response to the upward movement of the movable operating member 5, and therefore the bimetal 7 can return to be convex upward. In that state, the distal end of the movable operating member 5 is also pushed upward, and the pushed distal end of the movable operating member 5 separates the movable contact 3 from the stationary contact 2 upward. The thermostat is structured so that the shaft portion 5*c* of the movable operating member 5 does not drop off from the bearing groove 1*k* of the housing 1 even when the reset shaft 8 is properly pushed.

In the thermostat in this embodiment, when the reset shaft 8 is pushed, the movable contact 3 is moved upward via the movable operating member 5 so as not to be in contact with the stationary contact 2 by disposing the stationary contact 2 on the lower side and by disposing the movable contact 3 on the upper side. Therefore, as shown in FIG. 7, the movable contact 3 is separated from the stationary contact 2 and electrical continuity is reliably interrupted, even if the reset shaft 8 has been pushed in a state in which the thermostat does not operate. Therefore, the apparatus can be reliably prevented from undergoing abnormal heating and from being damaged, and therefore the safety of the apparatus can be achieved.

Embodiment 2

Figure 8A:
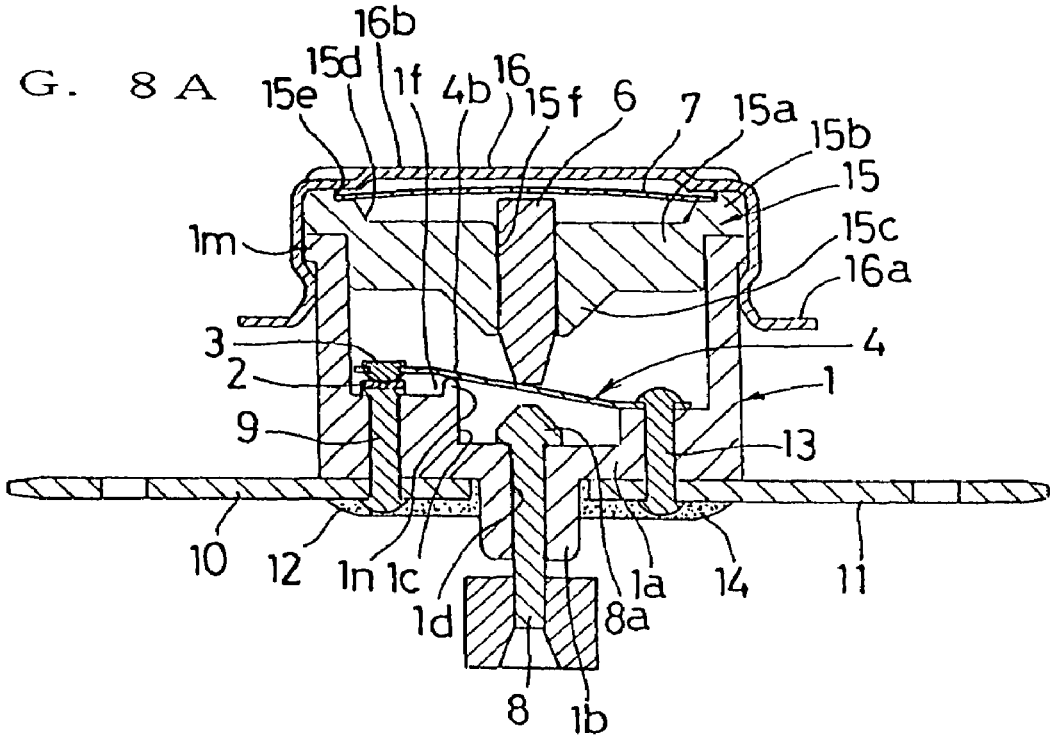
Figure 8B:
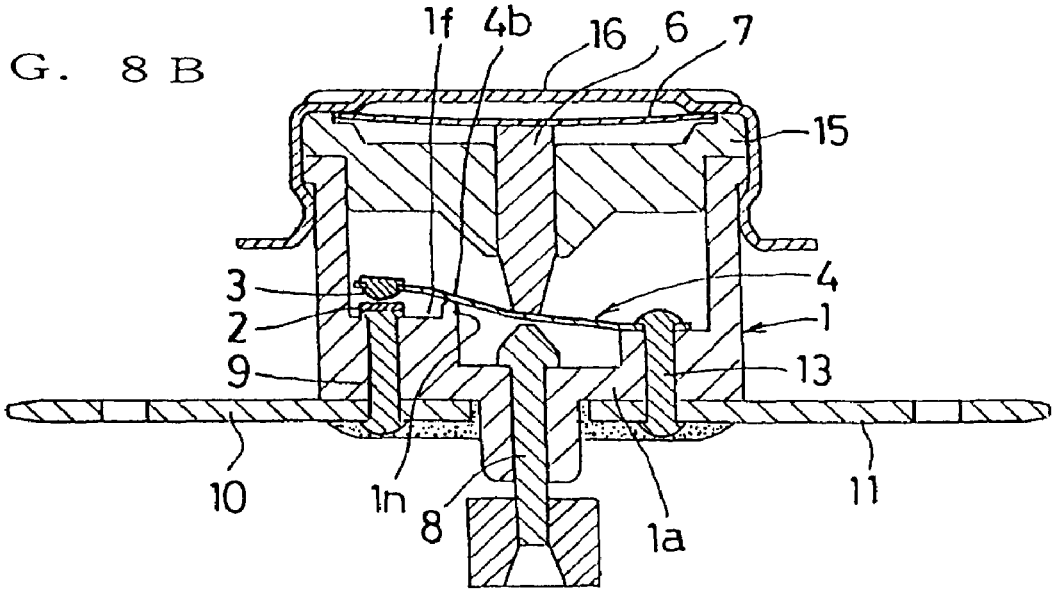

FIG. 8A and FIG. 8B are longitudinal sectional views, each showing a second embodiment of the manual-reset thermostat according to the present invention, in which FIG. 8A shows an initial state of the thermostat, and FIG. 8B shows a state in which the bimetal has performed a reverse action.

Since the thermostat in the second embodiment basically has the same structure as in the first embodiment, a description will be hereinafter given centering on differences between the first and second embodiments, and the same reference numerals as in the first embodiment are given to the same or equivalent elements.

As in the first embodiment, the thermostat in the second embodiment has a substantially cylindrical housing 1 opened upward. As in the first embodiment, an inner lid 15, a guide pin 6, a bimetal 7, and a cap 16 are provided on the upper part of the housing 1. On the other hand, as in the first embodiment, a first terminal 10, a second terminal 11, a first connecting member 9, a second connecting member 13, a leaf spring 4, a stationary contact 2 disposed on the upper part of the first connecting member 9, a movable contact 3 disposed on the distal end of the leaf spring 4, and a reset shaft 8 are provided on the bottom wall 1*a* of the housing 1. However, a movable operating member 5 is not provided in the second embodiment.

In the first embodiment, the shoulder portion 1*h* is provided on the bottom wall 1*a* of the housing 1 at the position where a part on the side of the proximal end of the leaf spring 4 is disposed. In the second embodiment, on the contrary, the shoulder portion 1*n* is provided at the position where a part on the side of the distal end of the leaf spring 4 is disposed. In this embodiment, a first depression 1*f* is formed on the upper part of the shoulder portion 1*n*, and the stationary contact 2 is disposed inside the first depression 1*f*.

In this embodiment, the first connecting member 9 and the second connecting member 13 are members merely extending upward and downward, not being shaped almost like the capital letter L. The stationary contact 2 is disposed on the upper end of the first connecting member 9. As in the first embodiment, the first terminal 10 is connected to the lower end of the first connecting member 9. On the other hand, the proximal end of the leaf spring 4 is held in the upper end of the second connecting member 13. In the example shown in FIG. 8A and FIG. 8B, the proximal end of the leaf spring is attached to the second connecting member 13 by fastening the upper end of the second connecting member 13 and is held between the fastened part and the upper surface of the bottom wall 1*a*. As in the first embodiment, the second terminal 11 is connected to the lower end of the second connecting member 13.

As mentioned above, the proximal end of the leaf spring 4 is fixed to the upper part of the second connecting member 13. On the other hand, the movable contact 3 is fixed to the distal end of the leaf spring 4. In the leaf spring 4, a connection portion between the distal end and the proximal end becomes more inclined upward correspondingly with an advance to the distal end. The shoulder portion 1*n* is formed integrally with the bottom wall 1*a* of the housing 1 on the side where the stationary contact 2 is disposed. The stationary contact 2 is disposed inside the first depression 1*f* formed on the upper surface of the shoulder portion 1*n*. Further, the leaf spring 4 has a pressing portion 4*b* whose undersurface is pressed onto the upper end of the peripheral wall of the first depression 1*f* (i.e., the upper end of the shoulder portion 1*n*) between a contact part with a mount part of the movable contact 3 on the side of the distal end of the leaf spring 4 and a contact part with the guide pin 6 or the reset shaft 8 disposed at the middle.

Although the leaf spring 4 of the first embodiment has the through hole 4*a* formed at the position corresponding to the guide pin 6 and to the reset shaft 8, the leaf spring 4 of the second embodiment does not have the through hole 4*a* formed at the position corresponding to the guide pin 6 and to the reset shaft 8. Therefore, at the middle part of the leaf spring 4, the lower end of the guide pin 6 can come into contact with the upper surface of the leaf spring 4, and the upper end of the reset shaft 8 can come into contact with the undersurface thereof. In the thermostat shown in FIG. 8A and FIG. 8B, the lower end of the guide pin 6 is tapered, and a head 8*a* of the upper end of the reset shaft 8 is also tapered.

As shown in FIG. 8A, in the thermostat of this embodiment, the movable contact 3 is usually in contact with the stationary contact 2 by the urging force of the leaf spring 4 in a state in which the bimetal 7 is convex upward. However, when a predetermined temperature is reached, the bimetal 7 performs a reverse action so as to be convex downward as shown in FIG. 8B, so that the lower end of the guide pin 6 presses the middle part of the leaf spring 4 downward. Thereby, the pressing portion 4*b* of the leaf spring 4 is pressed onto the upper end of the shoulder portion 1*n*, so that the movable contact 3 closer to the distal end than the pressing portion 4*b* is raised upward. Therefore, the movable contact 3 is separated from the stationary contact 2 upward, and electrical continuity between the contacts 2 and 3 is interrupted.

Accordingly, in this embodiment, when the bimetal 7 is reversely curved, the guide pin 6 presses the leaf spring 4 downward, and the pressing portion 4*b* closer to the distal end than the pressed part and closer to the proximal end than the movable contact 3 is brought into contact with a projection formed on the base 1 (in this embodiment, the upper end of the peripheral wall of the first depression 1*f*). Therefore, the leaf spring 4 is supported by the proximal end and the projection part, and a part therebetween is pressed by the guide pin 6 downward, so that the part closer to the distal end than the pressing portion 4*b* is curved upward. As a result, the movable contact 3 is separated from the stationary contact 2 upward, and electrical continuity between the first terminal 10 and the second terminal 11 is interrupted.

Embodiment 3

Figure 9B:
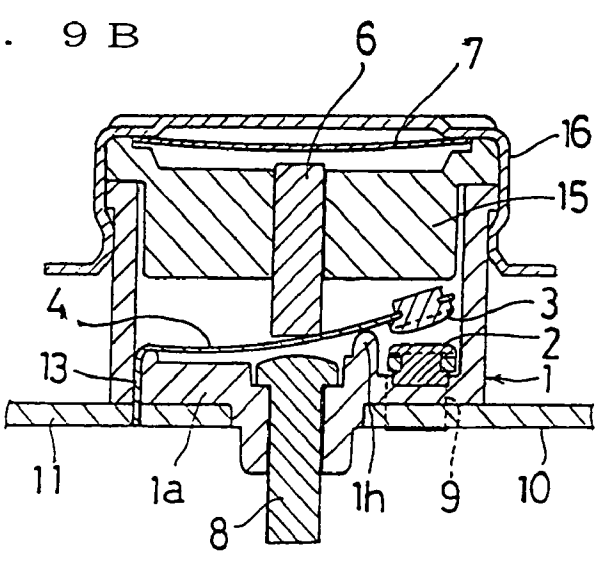
Figure 9C:
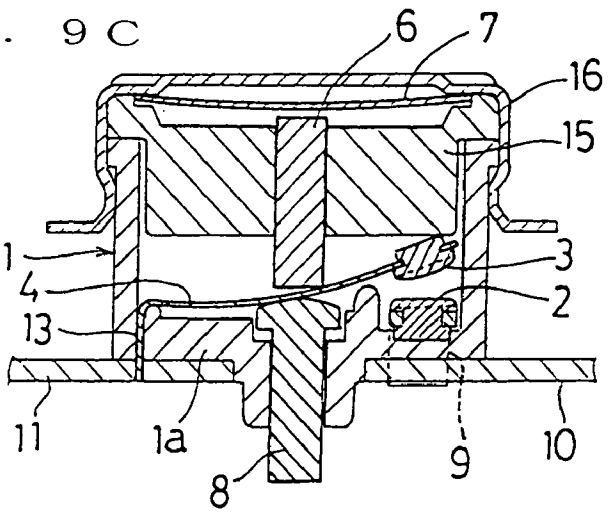
Figure 9A:
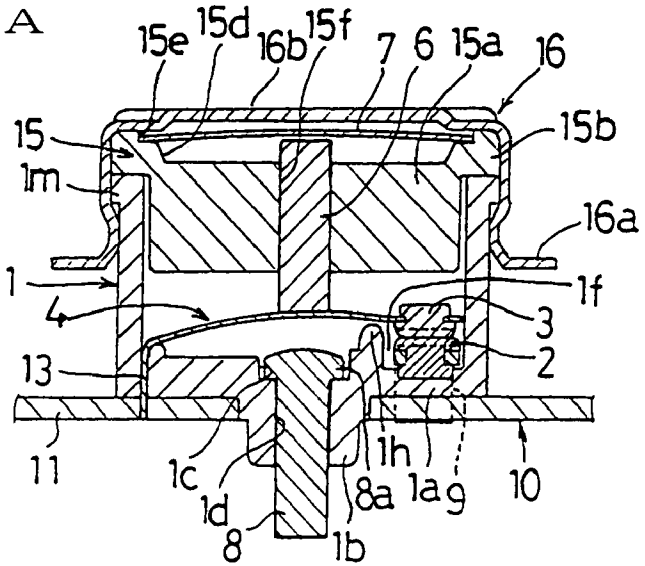
Figure 9D:
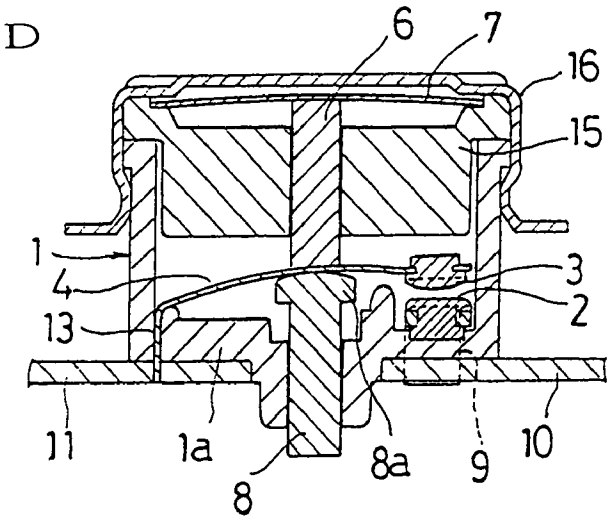
Figure 10A:
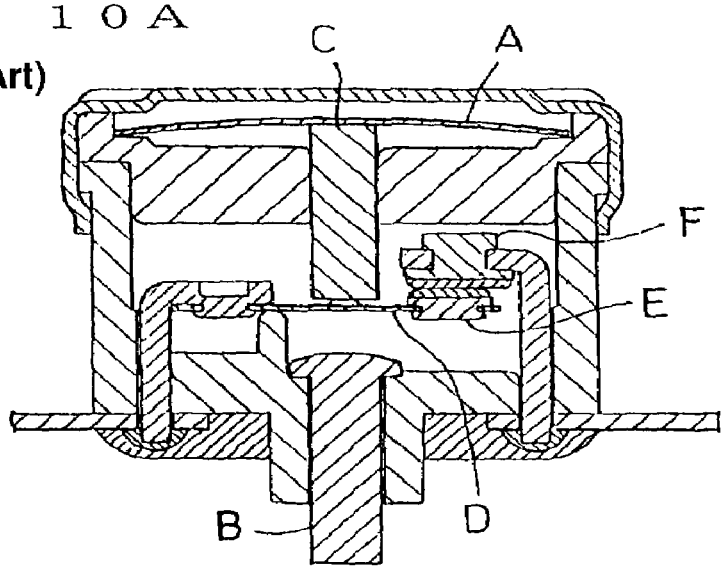
FIG. 10A (Prior Art)
Figure 10B:
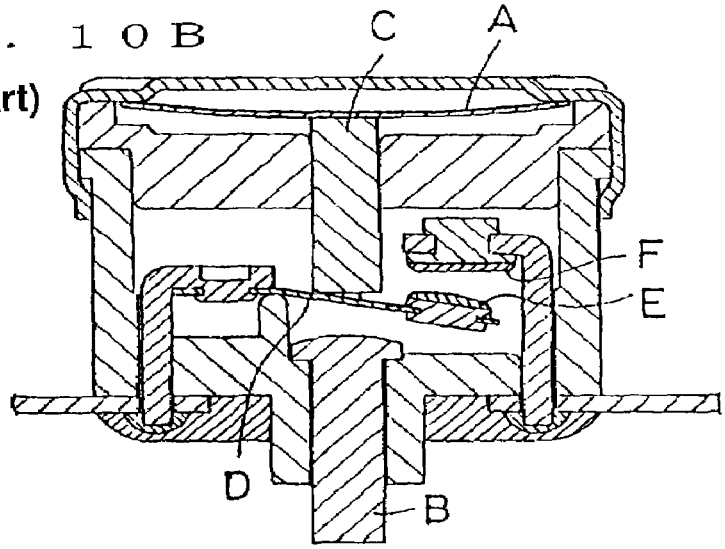
FIG. 10B (Prior Art)
Figure 10C:
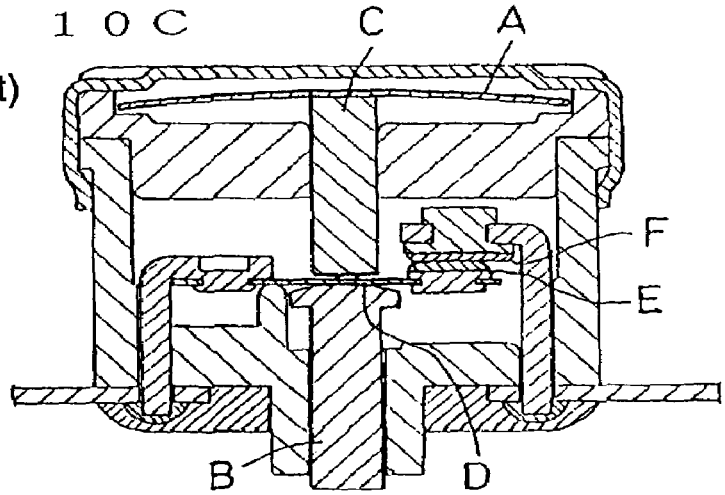
FIG. 10C (Prior Art)
Figure 11A:
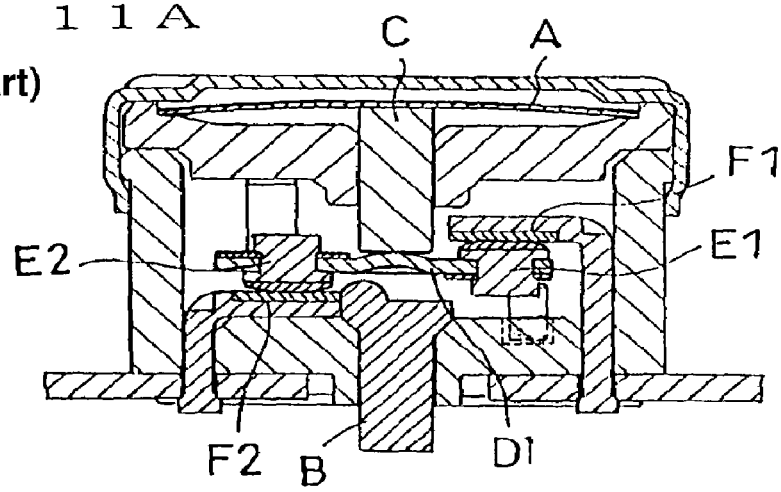
FIG. 11A (Prior Art)
Figure 11B:
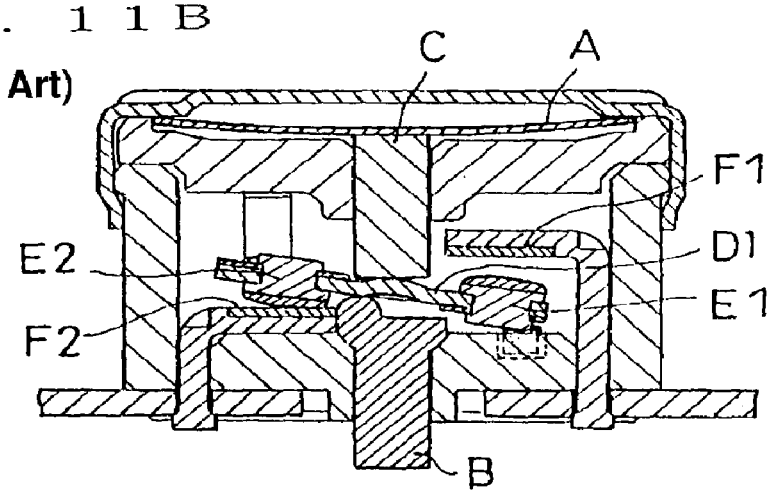
FIG. 11B (Prior Art)
Figure 11C:
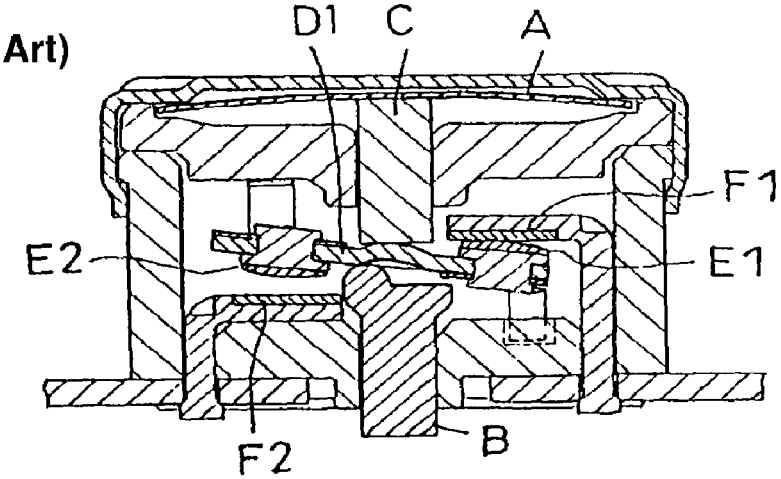
FIG. 11C (Prior Art)

FIGS. 9A to 9D are longitudinal sectional views, each showing a third embodiment of the manual-reset thermostat according to the present invention, in which FIG. 9A shows an initial state of the thermostat, FIG. 9B shows a state in which the bimetal has performed a reverse action, FIG. 9C shows a state in which the bimetal is being returned to the initial state by pushing the reset shaft, and FIG. 9D shows a state in which the bimetal has been returned to the initial state by pushing the reset shaft.

Since the thermostat in the third embodiment basically has the same structure as in the second embodiment, a description will be hereinafter given centering on differences between the second and third embodiments, and the same reference numerals as in the foregoing embodiments are given to the same or equivalent elements.

The thermostat of the third embodiment differs from that of the second embodiment in the structure of the leaf spring 4. The leaf spring 4 of the second embodiment is structured to undergo elastic deformation by pressing the pressing portion 4*b* onto the projection of the base 1 (i.e., the upper end of the shoulder portion 1*n*), whereas the leaf spring 4 of the third embodiment is structured to have the same snap action capability as the bimetal 7.

In more detail, when the leaf spring 4 of the third embodiment is displaced to a predetermined position by allowing its middle part to be pressed downward by the guide pin 6, the leaf spring 4 performs a reverse snap action, and maintains the reversely-curved state even if a load is not imposed later. In order to return the leaf spring 4 to the original state, a load in the opposite direction is applied by the reset shaft 8, and, when a predetermined displacement is achieved, the leaf spring 4 performs a snap action and is returned to the original state.

In the third embodiment, the guide pin 6 and the reset shaft 8 have the same structures as in the first embodiment. However, in the reset shaft 8 shown in FIGS. 9A to 9D, the upper surface of the head 8*a* is shaped like a gentle sphere expanding upward.

In the thermostat of this embodiment, in a state of being ordinarily used, the bimetal 7 and the leaf spring 4 are convex upward as shown in FIG. 9A. Thereby, the movable contact 3 is urged downward by the leaf spring 4, and is brought into contact with the stationary contact 2.

However, when a predetermined temperature is reached, the bimetal 7 is reversely curved so as to be convex downward as shown in FIG. 9B, and the lower end of the guide pin 6 presses the middle part of the leaf spring 4 downward. In response thereto, the leaf spring 4 is reversely curved so as to be convex downward, and the distal end thereof is curved upward. As a result, the movable contact 3 is moved upward, and is separated from the stationary contact 2. In order to reliably separate the contacts from each other, it is recommended to provide a projection on the base 1 as in the second embodiment.

In order to return from the state of FIG. 9B to the initial state of FIG. 9A, the reset shaft 8 is pushed upward as shown in FIG. 9C and FIG. 9D. When the reset shaft 8 is pushed upward, the movable contact 3 is pushed upward as it is, and is soon brought into contact with the inner lid 15. When the reset shaft 8 is further pushed upward in the state of supporting the distal end of the leaf spring 4 in this way, the leaf spring 4 is reversely curved and is returned to the initial state. When the leaf spring 4 is returned to the initial state, the guide pin 6 is pushed upward, and the guide pin 6 pushes the bimetal 7 upward, so that the bimetal 7 can be reversely curved and returned to the initial state.

As in the aforementioned embodiments, the head 8*a* of the reset shaft 8 pushes the middle part of the leaf spring 4 upward in a state in which the reset shaft 8 is pushed upward as shown in of FIG. 9D, and the movable contact 3 is separated from the stationary contact 2 upward in this embodiment.

Without being limited to the structures mentioned in the foregoing embodiments, the manual-reset thermostat according to the present invention can be variously modified. Especially, the shape and the size of each member can be appropriately set. Likewise, the thermostat can be used for various purposes. Further, in the first embodiment, the head 8*a* of the reset shaft 8 may be shaped like a quadrangle without being limited to a circle. If the head 8*a* is shaped like a flat quadrangle, the contact part with the movable operating member 5 can be increased, and a stable contact state can be obtained.

Although the proximal end of the leaf spring 4 is placed and held between the second connecting member 13 and the base 1 in the first embodiment, the proximal end of the leaf spring 4 may be connected only to the second connecting member 13 without being in contact with the base 1. Moreover, as in the third embodiment, the leaf spring 4 and the second connecting member 13 may be formed of the same member. If so, the proximal end of the leaf spring 4 is bent to be shaped almost like the capital letter L, and a part thereof extending downward is used as the second connecting member 13.

What is claimed is:

1. A manual-reset thermostat comprising:

a movable contact disposed above a stationary contact and urged downward so as to come into contact with said stationary contact;

a movable operating member comprising a distal end adjacent to the movable contact and a proximal end adjacent to a guide pin whose distal end is moved upward by allowing the proximal end thereof to be pressed downward, said movable operating member separating said movable contact from said stationary contact upward by moving the distal end thereof upward;

said guide pin that presses the proximal end of said movable operating member downward in response to the reverse action of a bimetal; and a reset shaft that returns said bimetal to an initial state via said guide pin, said reset shaft pressing said movable operating member upward, said movable operating member pressing said guide pin upward and also pressing said movable contact upward.

2. A manual-reset thermostat comprising:

a stationary contact fixed to a base;

a movable contact urged downward by a leaf spring so as to come into contact with an upper surface of said stationary contact;

a movable operating member swingably borne by said base comprising a distal end adjacent to the movable contact and a proximal end adjacent to a guide pin and in which the distal end thereof is moved upward by allowing the proximal end thereof to be pressed downward and in which said movable contact is separated from said stationary contact upward by moving the distal end thereof upward;

the guide pin disposed on an upper part on the side of the proximal end of said movable operating member so as to be vertically movable, said guide pin pressing the proximal end of said movable operating member downward in response to a reverse action of a bimetal; and a reset shaft disposed on a lower part of said movable operating member so as to be vertically movable, said reset shaft pressing said movable operating member upward, the distal end of said movable operating member pressing said movable contact upward, the proximal end of said movable operating member pressing said guide pin upward making said bimetal return to an initial state.

3. The manual-reset thermostat according to claim 2, wherein:

said base is formed of a closed-end housing opened upward; said stationary contact, said movable contact, said leaf spring, said movable operating member, and said reset shaft are provided in said housing;

said guide pin is vertically movably held by an inner lid held by an opening of an upper part of said housing; and said bimetal is held between said inner lid and a cap disposed on an upper part thereof, said cap fixing said inner lid to said housing.

4. The manual-reset thermostat according to claim 3, wherein:

said housing is shaped like a cylinder;

said bimetal is shaped like a disk;

said guide pin and said reset shaft are disposed along a middle part of said housing;

a lower end of said guide pin is passed through said leaf spring and is brought into contact with an upper part on the side of the proximal end of said movable operating member; and said reset shaft is held by said housing so as not to drop off therefrom while protruding from a bottom of said housing.

5. The manual-reset thermostat according to claim 1, wherein said movable operating member is formed of a V-shaped member, and is held swingably around a shaft provided at a bent part thereof.

6. The manual-reset thermostat according to claim 2, wherein said movable operating member is formed of a V-shaped member, and is held swingably around a shaft provided at a bent part thereof.

7. The manual-reset thermostat according to claim 3, wherein said movable operating member is formed of a V-shaped member, and is held swingably around a shaft provided at a bent part thereof.

8. The manual-reset thermostat according to claim 4, wherein said movable operating member is formed of a V-shaped member, and is held swingably around a shaft provided at a bent part thereof.

* * * * *